United States Patent [19]

Shiozaki et al.

[11] 4,152,912

[45] May 8, 1979

[54] METAL ROLLING PROCESS AND MILL

[75] Inventors: Hiroyuki Shiozaki, Yokosuka; Masao Mikami, Fujisawa, both of Japan

[73] Assignee: Ishikawajima-Harima Jukogyo Kabushiki Kaisha, Tokyo, Japan

[21] Appl. No.: 880,933

[22] Filed: Feb. 24, 1978

[51] Int. Cl.[2] ..... B21B 37/00

[52] U.S. Cl. ..... 72/10; 72/249

[58] Field of Search ..... 72/10, 16, 19, 205, 72/199, 366, 8, 17

[56] References Cited

U.S. PATENT DOCUMENTS

| | | | |
|---|---|---|---|
| 3,599,459 | 8/1971 | Yeomans et al. | 72/8 |
| 3,802,237 | 4/1974 | Patula et al. | 72/17 |

FOREIGN PATENT DOCUMENTS

| | | | |
|---|---|---|---|
| 457669 | 3/1928 | Fed. Rep. of Germany | 72/366 |
| 309754 | 4/1971 | U.S.S.R. | 72/366 |

*Primary Examiner*—Milton S. Mehr

*Attorney, Agent, or Firm*—Scrivener, Parker, Scrivener & Clarke

[57] ABSTRACT

Metal rolling process and mill wherein the ratio in peripheral velocity between a pair of upper and lower work rolls is so controlled that a metal may be rolled to a desired shape or to close thickness tolerances.

2 Claims, 5 Drawing Figures

METAL ROLLING PROCESS AND MILL

DETAILED DESCRIPTION OF THE INVENTION

The present invention relates to a metal rolling process and apparatus therefor for rolling good shape sheet or strip.

One of the objects of the present invention is to provide a process and apparatus for improving the capability of correcting the shape or the crown of the rolled sheet or strip, whereby the so-called flat metal sheet or strip may be produced.

Another object of the present invention is to provide a process and apparatus for automatically correcting the shape or the crown of a rolled sheet or strip, whereby the rolling efficiency may be considerably improved.

A further object of the present invention is to provide a rolling mill which is simple in construction and easy to assemble.

In general, the roll bending apparatus or the method for controlling the thermal deformation of rolls have been employed in order to control the shape of the rolled sheet or strip, but their abilities are limited so that the sheet metal in desired shape may not be produced.

In addition, there has been also used a process wherein crown ratio of the sheet or strip is maintained constant throughout the whole pass schedule, in that case a flat sheet metal prior to rolling may be rolled into a flat sheet metal. However in order to maintain the crown ratio constant, the reduction in thickness must be restricted at each pass, thereby adjusting the rolling force. As a result, the number of passes increases, resulting in the decrease in productivity.

In order to maintain a predetermined crown ratio, the following equation must be held:

$$\frac{C_{r,i-1}}{\frac{1}{2}(h_{c,i-1}+h_{e,i-1})}=\frac{C_{r,i}}{\frac{1}{2}(h_{c,i}+h_{e,i})}$$

wherein $C_{r,i}$=the crown of the sheet metal after rolling and $=h_{c,i}-h_{e,i}$ $h_{c,i}$=the thickness of the sheet metal at the center thereof after rolling, and $h_{e,i}$=the thickness of the sheet metal at the edges thereof after rolling.

By using roll bending method, the number of passes maintaining the above conditions may be reduced, but the roll bending force is limited from the standpoint of roll chock design so that the capability of controlling the shape of the rolled metal is also limited. As a result the sheet metal in desired shape cannot be obtained.

The present invention was made to overcome the above and other problems encountered in the conventional rolling rprocesses and will become apparent from the following description of one preferred embodiment thereof taken in conjunction with the accompanying drawings, in which.

Figure 1:
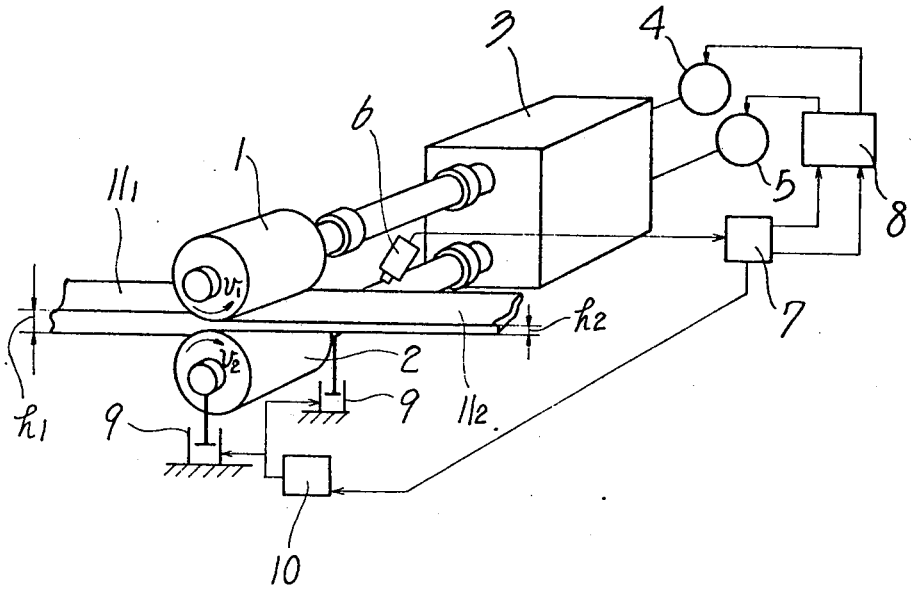
FIG. 1 is a schematic perspective view of a rolling mill in accordance with the present invention.

Referring to FIG. 1, an upper work roll 1 and a lower work roll 2 are drivingly coupled through a reduction gear 3 to the output shafts of motors 4 and 5 in such a way that the upper and lower work rolls 1 and 2 may rotate at different peripheral velocities $v_1$ and $v_2$, respectively. It is of course to be understood that the upper and lower work rolls 1 and 2 may be directly coupled to the output shafts of the motors 4 and 5.

A sheet metal $11_1$ having the thickness $h_1$ is rolled by the upper and lower work rolls 1 and 2 into a sheet metal $11_2$ having the thickness $h_2$. The rolled sheet metal $11_2$ is always monitored by a shape detector 6 connected to an arithmetic unit 7 which in turn is connected not only to a control unit 8 connected to the motors 4 and 5 but also to a roll gap control unit 10. Therefore in response to the output signal from the shape detector 6, the arithmetic unit 7 generates the shape correction signal, and in response to this shape correction signal the control unit 8 controls the rotational speeds of the motors 4 and 5, whereby the peripheral velocities of the upper and lower work rolls 1 and 2 may be controlled.

The roll gap control unit 10 is connected to a pair of roll gap setting units 9 so that in response to the shape correction signal from the arithmetic unit 7 the control unit 10 causes the roll gap setting units 9 to operate in such a way that the lower work roll 2 may be spaced apart from the upper work roll 1 by a desired distance.

With the rolling mill of the type described, the ratio between the peripheral velocities of the upper and lower work rolls 1 and 2 are varied so that the rolling force may be varied and consequently the deformation of the work rolls 1 and 2 may be controlled and the shape of the rolled metal may be corrected as will be described in detail hereinafter.

Figure 2:
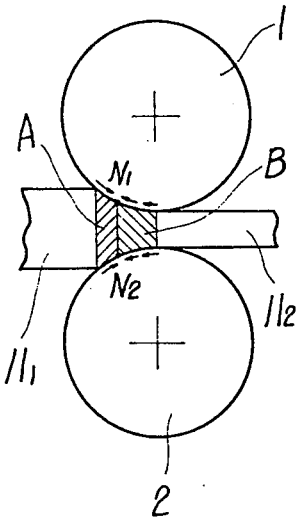
FIGS. 2, 3 and 4 are views used for the explanation of the relationship between the ratio between the peripheral velocities of the upper and lower work rolls and the frictional force.
Figure 3:
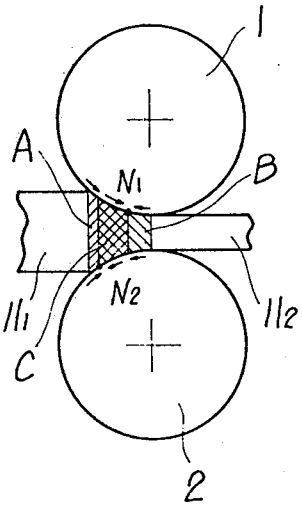
Figure 4:
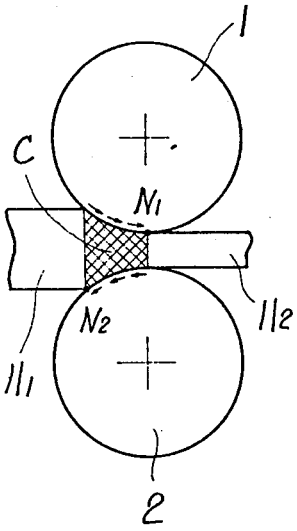

Referring to FIGS. 2, 3 and 4 it is assumed that the upper and lower work rolls 1 and 2 have the same diameter and thickness of the sheet metal prior to and after rolling. The neutral lines or points are designated by $N_1$ and $N_2$.

FIG. 2 shows conventional rolling condition, wherein the upper and lower work rolls 1 and 2 are rotated at the same peripheral velocity, the neutral points $N_1$ and $N_2$ are on the same vertical line, and in the roll bite zones A and B the sheet metal is subjected to the frictional force in the directions indicated by the arrows from the upper and lower work rolls 1 and 2. As a result, the sheet metal is subjected to the horizontal compression force so that the vertical compression force or the rolling force are greater than when the sheet metal is not subjected to the frictional force.

FIG. 4 shows the so-called rolling drawing process wherein the peripheral velocities $v_1$ and $v_2$ of the upper and lower work rolls 1 and 2 are so selected as to satisfy the following condition $$v_1/v_2=h_1/h_2$$

where $h_1$ and $h_2$ are the thickness of the metal entering and leaving the work rolls.

Therefore in the roll bite zone C the frictional force on the metal along the contact arc between the sheet metal and the upper work roll 1 are opposite in direction to the frictional force on the metal along the contact arc between the sheet metal and the lower work roll 2. In other words, the upper neutral point $N_1$ is at the exit point of the upper contact arc while the lower neutral point $N_2$ is at the entrance point of the lower contact arc. As a consequence the sheet metal is not subjected to the horizontal compression force and the rolling pressure is independent of the frictional force and is smaller than the rolling force shown in FIG. 2.

In FIG. 3 the peripheral velocities of the upper and lower work rolls 1 and 2 are so controlled that the upper and lower neutral points $N_1$ and $N_2$ are displaced from the exit point of the upper contact arc and the entrance point of the lower contact arc and are not on the same vertical line. As a result on both sides of the bite zone C the sheet metal is subjected to the frictional force which are in the same conditions for the conventional rolling. Therefore the rolling force is intermediate between the rolling force shown in FIGS. 2 and 4.

From the above explanation it is apparent that the rolling force may be varied by changing the ratio between the peripheral velocities of the upper and lower work rolls 1 and 2. When the rolling force is varied while the thickness $h_1$ prior to the rolling and the thickness $h_2$ after rolling are maintained constant, the roll deformation is varied so that the sectional profile of the rolled metal is varied. As the sectional profile of the rolled metal is varied, the distribution of the elongation of metal in the width direction is also varied so that the shape of the rolled metal is also varied. Thus the shape of the rolled metal may be controlled by changing the ratio between the peripheral velocities of the upper and lower work rolls 1 and 2.

Next the rolling process with the above rolling mill will be described. In response to the output signal from the shape detector 6 which continuously detects the shape of the rolled metal $\mathbf{11}_2$, the arithmetic unit 7 computes an increment or decrement $\Delta p$ of the rolling force required for correcting the shape of the sheet metal being rolled and the peripheral velocities $v_1$ and $v_2$ of the upper and lower work rolls 1 and 2 required for producing the above increment or decrement $\Delta p$. In response to the output signal from the arithmetic unit 7, the motor control unit 8 controls the speed of the motors 4 and 5 and hence the peripheral velocities of the upper and 1 lower work rolls 1 and 2.

Figure 5:
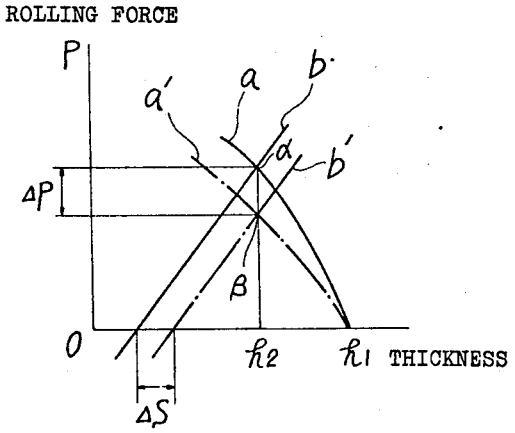
FIG. 5 is a graph illustrating the relationship between the rolling force and the thickness of the rolled metal.

Instead of detecting the shape of the rolled metal $\mathbf{11}_2$, the sheet crown prior to and after the rolling may be detected whereby the speed of the motors 4 and 5 may be controlled. Furthermore the speed of the motors 4 and 5 may be controlled in response to the shape or crown of the sheet predicted prior to rolling. However, in order to avoid the deviation of the thickness of the rolled metal sheet $\mathbf{11}_2$ from $h_2$, $\beta$, the intersection between the mill elastic characteristic curve b' and the metal plastic characteristic curve a' after the correction of shape must be on the same vertical line passing $\alpha$, the intersection between the mill elastic characteristic curve b and the plastic characteristic curve a prior to the correction of shape as shown in FIG. 5. Furthermore the roll gap between the upper and lower work rolls 1 and 2 must be increased or decreased by $\Delta S = \Delta p/K$, where K is the coefficient of mill modulus so that the thickness $h_2$ after rolling remains same regardless of the increment or decrement $\Delta p$ of the rolling force.

The arithmetic unit 7 computes the roll gap increment or decrement $\Delta S$ in the manner described above, and in response to the output representative of this increment or decrement $\Delta S$ from the arithmetic unit 7 the roll gap control unit 10 operates the roll gap setting units 9 so that the gap between the upper and lower work rolls 1 and 2 may be increased or decreased by $\Delta S$.

According to the experiments conducted by the inventors, it was found that when the mild steel is rolled by the rolling drawing process shown in FIG. 4, the rolling force is reduced to, for examples, approximately $\frac{1}{3}$ of the rolling force required in the conventional rolling process shown in FIG. 2. As a result, the sheet crown is also reduced by approximately $\frac{1}{3}$. Thus as compared with the conventional rolling processes and rolling mills, the ability of correcting the sheet shape and hence the shape of the rolled sheet metal may be remarkably improved.

It is to be understood that the present invention is not limited to the preferred embodiment described above and that various modifications may be effected without departing the true spirit of the present invention.

We claim:

1. A metal rolling process which comprises detecting the shape of the rolled metal, and controlling the ratio in peripheral velocity between an upper work roll and a lower work roll in response to the detected shape of the rolled metal in such a way that the rolled metal may have a desired shape.

2. A rolling mill comprising a pair of upper and lower work rolls, work roll drive equipment for driving said upper and lower work rolls at different peripheral velocities, means for detecting the shape of the rolled metal, and control means responsive to the detected shape of the rolled metal for computing the peripheral velocities of said upper and lower work rolls required for the correction of the shape of the rolled metal and controlling said work roll drive equipment so that said upper and lower work rolls may be driven at said computed peripheral velocities.

* * * * *